US009671739B2

(12) United States Patent
Yamakawa

(10) Patent No.: US 9,671,739 B2
(45) Date of Patent: Jun. 6, 2017

(54) SHEET-CONVEYING DEVICE THAT CONVEYS SHEETS, AND IMAGE-FORMING APPARATUS USING THE SAME

(71) Applicant: KONICA MINOLTA, INC., Chiyoda-ku, Tokyo (JP)

(72) Inventor: Mikihiro Yamakawa, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/933,907

(22) Filed: Nov. 5, 2015

(65) Prior Publication Data

US 2016/0154362 A1 Jun. 2, 2016

(30) Foreign Application Priority Data

Nov. 28, 2014 (JP) ..... 2014-241913

(51) Int. Cl.

| | |
|---|---|
| ***G03G 15/00*** | (2006.01) |
| ***B65H 29/12*** | (2006.01) |
| ***B65H 29/52*** | (2006.01) |
| ***B65H 5/06*** | (2006.01) |

(Continued)

(52) U.S. Cl.

CPC ..... *G03G 15/6558* (2013.01); *B65H 5/068* (2013.01); *B65H 5/36* (2013.01); *B65H 9/103* (2013.01); *B65H 29/125* (2013.01); *B65H 29/52* (2013.01); *B65H 2404/1424* (2013.01);

(Continued)

(58) Field of Classification Search

CPC ..... G03G 2215/00586; G03G 15/6558; G03G 15/6561; G03G 2215/00405; G03G 2215/00556; B65H 29/125; B65H 29/52; B65H 5/068; B65H 5/36; B65H 9/103;

(Continued)

(56) References Cited

U.S. PATENT DOCUMENTS

| | | | | |
|---|---|---|---|---|
| 6,173,952 | B1 * | 1/2001 | Richards | B65H 5/062 271/228 |
| 8,783,440 | B2 * | 7/2014 | Yamazaki | B65G 13/02 198/457.02 |
| 2012/0301198 | A1 * | 11/2012 | Momiyama | G03G 15/234 399/361 |

FOREIGN PATENT DOCUMENTS

| | | | | |
|---|---|---|---|---|
| JP | 2000335787 | A | 12/2000 | |
| JP | EP 1892582 | A1 * | 2/2008 | B65H 9/004 |

(Continued)

OTHER PUBLICATIONS

Japanese Office Action (and English translation thereof) dated Nov. 15, 2016 issued in counterpart Japanese Application No. 2014-241913.

*Primary Examiner* — Matthew G Marini
(74) *Attorney, Agent, or Firm* — Holtz, Holtz & Volek PC

(57) ABSTRACT

A sheet-conveying device has a guide member that constitutes a sheet-conveying route, a plurality of rollers and a control portion that performs a sheet-position correction operation. The plurality of rollers is provided at plural portions of the guide member. Each roller projects from the guide member, contacts a sheet and rotates together with the conveyance of the sheet. The control portion searches the roller(s) 6 arranged at positions that may contact the end surface of the sheet along the width direction thereof in the register fluctuation operation to produce positional information of the roller(s) to be escaped. The control portion escapes the roller(s) specified by the positional information of the roller(s) to be escaped before a register fluctuation operation starts.

18 Claims, 8 Drawing Sheets

(51) Int. Cl.
*B65H 5/36* (2006.01)
*B65H 9/10* (2006.01)

(52) U.S. Cl.
CPC ..... *B65H 2404/1521* (2013.01); *B65H 2404/6111* (2013.01)

(58) Field of Classification Search
CPC .... B65H 2404/1424; B65H 2404/1521; B65H 2404/6111
See application file for complete search history.

(56) References Cited

FOREIGN PATENT DOCUMENTS

| | | | |
|---|---|---|---|
| JP | 2013133223 | A | 7/2013 |
| JP | 2013212901 | A | 10/2013 |

* cited by examiner

SHEET-CONVEYING DEVICE THAT CONVEYS SHEETS, AND IMAGE-FORMING APPARATUS USING THE SAME

CROSS REFERENCES TO RELATED APPLICATIONS

The present invention contains subject matter related to Japanese Patent Application JP 2014-241913 filed in the Japanese Patent Office on Nov. 28, 2014, the entire contents of which being incorporated herein by reference.

BACKGROUND OF THE INVENTION

Field of the Invention

The present invention relates to a sheet-conveying device that conveys sheets and an image-forming apparatus that uses such a sheet-conveying device.

Description of Related Art

In an apparatus such as an image-forming apparatus, which uses a sheet-conveying device, a configuration in which a sheet-position correction operation is performed has been known. Such a sheet-position correction operation to correct a position of the sheet along a width direction thereof is performed by moving rollers with them nipping the sheet along the width direction of the sheet, which is perpendicular to a conveying direction of the sheet, after an inclination of the sheet toward a direction along a surface of the sheet has been corrected.

In the sheet-position correction operation, the conveying rollers that rotate along a conveying direction of the sheet have caused a resistance when the sheet moves along a width direction thereof. Therefore, Japanese Patent Application Publication No. 2013-133223 has proposed such a technology that all of the conveying rollers are escaped from a sheet-conveying route in the sheet-position correction operation.

Further, an apparatus such as an image-forming apparatus, which is provided with a configuration to convey the sheets, contains a guide member constituting a sheet-conveying route. In the image-forming apparatus, the sheet on which an image has been formed passes through the sheet-conveying route including the guide member.

When an image formed surface of the sheet comes into contact with the guide member, any scratch, for example, so-called image scratch may occur on the image formed surface of the sheet. Particularly, in a curved sheet-conveying route in which the guide member is formed to be curved, the sheet often comes into contact with the guide member, so that the image scratch is easy to occur therein.

Accordingly, a technology to provide for any roller which projects from the guide member constituting the sheet-conveying route, contacts the sheet and rotates together with the conveyance of the sheet has been proposed.

SUMMARY OF THE INVENTION

Thus, it is possible to prevent the image formed surface of the sheet from contacting the guide member by proving the guide member with the roller. As the result thereof, it is possible to prevent any image scratch from occurring. In the sheet-position correction operation, however, an end surface of the sheet along the width direction thereof may contact an end surface of the roller.

When the end surface of the sheet along the width direction thereof contacts the end surface of the roller, any defect may occur in the end surface of the sheet. Further, when the sheet moving to the width direction thereof runs onto the roller, a resistance may have been caused, so that the sheet may be flexed.

Additionally, in the sheet-position correction operation, although the end surface of the sheet along the width direction thereof does not contact any end surfaces of the rollers if all of the rollers are escaped from the sheet-conveying route, the image formed surface of the sheet contacts the guide member, thereby causing any image scratch.

The present invention addresses the above-described issues. The present invention has an object to provide a sheet-conveying device that prevents any scratch or defect from occurring in the sheet in the sheet-position correction operation in which the position of the sheet along the width direction thereof is corrected, and an image-forming apparatus that uses such a sheet-conveying device.

To achieve at least one of the above-described objects, a sheet-conveying device reflecting one aspect of the present invention is a sheet-conveying device that conveys a sheet, the device containing register rollers that move to a direction which is perpendicular to a conveying direction of the sheet with the register rollers nipping the sheet, and correct a position of the sheet, a guide member that constitutes a sheet-conveying route, the guide member being provided at an upstream side of the register rollers along the conveying direction of the sheet, a plurality of rollers, each roller projecting from the guide member, contacting the sheet and rotating together with the conveyance of the sheet, and the plurality of rollers being provided at plural portions of the guide member at the upstream side of the register rollers along the conveying direction of the sheet, an elevating mechanism that elevates each roller between a position in which each roller projects from the sheet-conveying route and a position to which each roller escapes, a deviation detection sensor that detects a position of the sheet on the width direction of the sheet along the direction which is perpendicular to the conveying direction of the sheet, and a control portion that is configured to perform a sheet-position correction operation in which the register rollers move to the direction which is perpendicular to a conveying direction of the sheet based on positional information of the sheet along the width direction thereof, the positional information being detected by the deviation detection sensor, and the position of the sheet on the width direction thereof is corrected along the direction which is perpendicular to a conveying direction of the sheet, wherein the control portion is configured to search among the plurality of the rollers a roller that is positioned at a position which the end surface of the sheet, moved in the sheet-position correction operation, along the width direction thereof contacts, to calculate positional information of the roller to be escaped and to control the elevating mechanism to escape the roller specified based on the positional information of the roller to be escaped from the sheet-conveying route before the sheet-position correction operation starts.

According to embodiments of the present invention, it is desired to provide the sheet-conveying device wherein the control portion is configured to search a roller that is positioned at a position which the end surface of the sheet, moved in the sheet-position correction operation, along the width direction thereof contacts, based on size information of the conveying sheet, from a width of the sheet specified by the size information and a predetermined set maximum moving amount of the sheet in the sheet-position correction operation corresponding to the width of the sheet, and to calculate the positional information of the roller to be escaped.

It is further desired to provide the sheet-conveying device wherein the control portion is configured to search a roller that is positioned at a position which the end surface of the sheet, moved in the sheet-position correction operation, along the width direction thereof contacts based on positional information of the sheet along the width direction thereof, the positional information being detected by the deviation detection sensor, and a width of the sheet specified by the size information of the conveying sheet, and to calculate the positional information of the roller to be escaped.

It is additionally desired to provide the sheet-conveying device wherein when the sheet-position correction operation to move the sheet along the direction which is perpendicular to the conveying direction of the sheet has been completed, the control portion is configured to control the elevating mechanism to project to the sheet-conveying route the roller which has been escaped from the sheet-conveying route before the sheet-position correction operation starts.

It is still further desired to provide the sheet-conveying device wherein the control portion is configured to control the elevating mechanism to project to the sheet-conveying route the roller which has been escaped from the sheet-conveying route before a forward end of a sheet next to a preceding sheet on which the sheet-position correction operation has been performed reaches the roller which has been escaped from the sheet-conveying route.

It is still additionally desired to provide the sheet-conveying device wherein the control portion is configured to control the elevating mechanism to project to the sheet-conveying route the roller which has been escaped from the sheet-conveying route before the forward end of the sheet next to the preceding sheet on which the sheet-position correction operation has been performed reaches the roller which has been escaped from the sheet-conveying route when the sheet-position correction operation to move the sheet along the direction which is perpendicular to the conveying direction of the sheet has been completed.

Other objects and attainments of the present invention will be become apparent to those skilled in the art upon a reading of the following detailed description when taken in conjunction with the drawing.

DESCRIPTION OF THE PREFERRED EMBODIMENTS

The following will describe embodiments of a sheet-conveying device and an image forming system using the same according to the present invention with reference to the drawings. Such description does not limit the technical scope, meaning of terms and the like in Claims.

Figure 1:
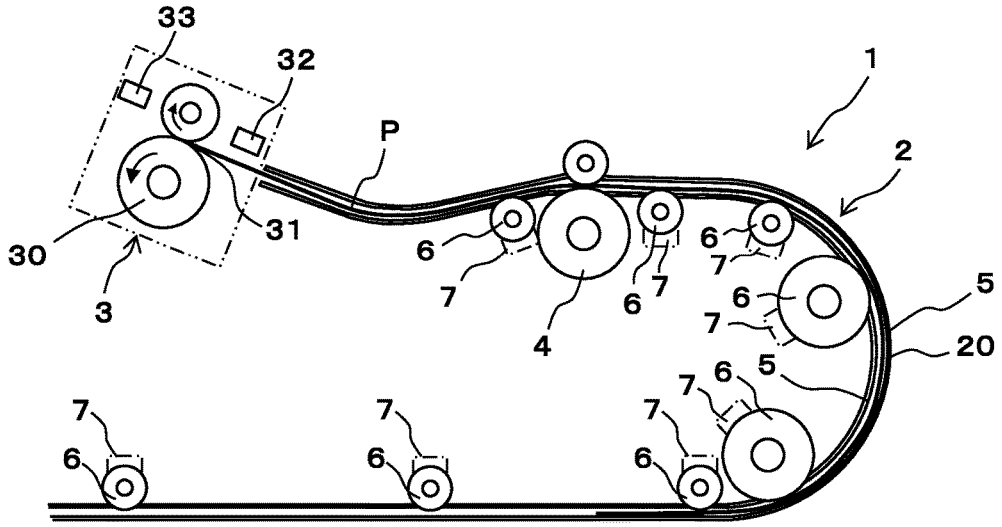
FIG. 1 is a diagram showing a configuration example of a sheet-conveying device according to an embodiment of the invention.
Figure 2:
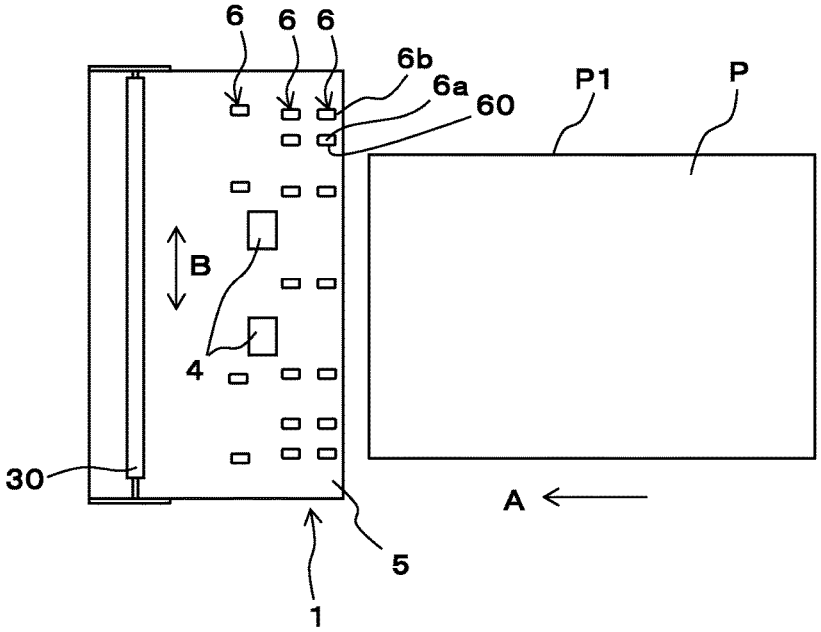
FIG. 2 is a diagram showing the configuration example of the sheet-conveying device according to the embodiment of the invention.

Configuration Examples of Sheet-Conveying Device According to Embodiments of Present Invention FIGS. 1 and 2 show a configuration example of a sheet-conveying device according to an embodiment of the invention. FIG. 1 is a schematic side view of the sheet-conveying device. FIG. 2 is a schematic top plan view of an important portion of the sheet-conveying device. It is to be noted that the sheet-conveying device according to this embodiment of the invention is preferably applied to a sheet-conveying mechanism near a register portion of the image-forming apparatus, which will be described later.

The sheet-conveying device 1 includes a sheet-conveying route 2 on which the sheet P is conveyed, and a register portion 3 by which an inclination of the sheet P, so-called a skew, and a deviation in the position of the sheet P along the width direction thereof which is perpendicular to the conveying direction of the sheet are corrected.

The sheet-conveying device 1 also includes conveying rollers 4 that convey the sheet P in the sheet-conveying route 2, guide member 5 constituting the sheet-conveying route, and rollers 6 that guide conveyance of the sheet P along the guide member 5. The sheet-conveying device 1 further includes an elevating mechanism 7 that escapes each of the rollers 6 from the sheet-conveying route 2.

The sheet-conveying route 2 has a curved sheet-conveying route 20 which constitutes a U-shaped curved sheet-conveying route. The register portion 3 is provided on the sheet-conveying route 2 at a downstream side of the curved sheet-conveying route 20 along the conveying direction of the sheet P shown by an arrow A.

The register portion 3 contains register rollers 30. The register rollers are configured to be a pair of rollers that are opposed to each other with them nipping the sheet P conveyed on the sheet-conveying route 2. Each roller of the register rollers 30 is provided with a shaft extending to a direction that is perpendicular to the conveying direction of the sheet P. The register rollers 30 are rotated in the reverse directions to each other as shown in arrows to convey the sheet P along the conveying direction of the sheet P.

The register portion 3 corrects the skew of the sheet P by hitting a forward end of the sheet P to a nip portion constituted by the pair of rollers while the register rollers 30 stop. The register portion 3 conveys the sheet P along the conveying direction thereof by reverse rotation of the register rollers 30. The register portion 3 corrects the deviation of the sheet P along the width direction thereof by moving the register rollers 30 to the width direction of the sheet P, as shown by an arrow B, which is perpendicular to the conveying direction of the sheet P, with the pair of the rollers nipping the sheet P. As described above, a series of sheet-position correction operations for correcting the deviation of sheet P along the width direction thereof is referred as "register fluctuation".

The register portion 3 includes a register sensor 32 that detects the sheet P that is conveyed on the sheet-conveying route 2. The register sensor 32 is positioned at an upstream side of the register rollers 30 along the conveying direction of the sheet P.

After the forward end of the sheet P that is conveyed on the sheet-conveying route 2 reaches a detection position of the register sensor 32, the register portion 3 corrects the skew of the sheet P by hitting the forward end of the sheet P to the nip portion 31 of the register rollers 30. Therefore, a necessary conveying amount of the sheet P is set on the basis of a distance between the detection position of the register sensor 32 and the nip portion 31 of the register rollers 30.

Thus, when the register sensor 32 detects the forward end of the sheet P conveying on the sheet-conveying route 2, the sheet P is conveyed according to the previously set conveying amount thereof, so that the forward end of the sheet P is stricken to the nip portion 31 of the register rollers 30 to correct the skew.

The register portion 3 also includes a deviation detection sensor 33 that detects the position of the sheet P along the width direction thereof. The deviation detection sensor 33 is positioned at a downstream side of the register rollers 30 along the conveying direction of the sheet P. For example, the deviation detection sensor 33 is constituted of a line sensor that extends along the width direction of the sheet P. In the register portion 3, an fluctuated amount of the sheet P in the register fluctuation operation (hereinafter, simply referred to as "register fluctuation operation"), which is a sheet-position correction operation, is calculated on the basis of the position of the sheet P along the width direction thereof or the like when the deviation detection sensor 33 detects an end surface P1 of the sheet P, which has been passed through the register rollers 30, along the width direction thereof.

Conveying rollers 4 are constituted of a pair of rollers that are opposed to each other with them nipping the sheet P conveying the sheet-conveying route 2. The conveying rollers 4 are positioned at an upstream side of the register rollers 30 along the conveying direction of the sheet P. Each of the conveying rollers 4 is provided with a shaft that extends to a direction that is perpendicular to the conveying direction of the sheet P. The conveying rollers 4 convey the sheet P along the conveying direction thereof by reverse rotation of the conveying rollers 4.

The conveying rollers 4 are referred to as "loop rollers" which correct the skew of the sheet P by conveying the sheet P to hit the forward end of the sheet P to the nip portion 31 of the register rollers 30 so that the sheet P becomes curved to form a loop.

The guide member 5 is constituted of a pair of guide plates that are set so as to be opposed to each other with the guide plates being also opposed to front and rear surfaces of the sheet P. The pair of guide plates has a space through which the sheet P can be passed. The guide member 5 curves like U-shape in the curved sheet-conveying route 20.

The rollers 6 are respectively positioned to stand in lines and are arranged at an upstream side of the register portion 3 along the sheet-conveying route 2. A part of a circumferential surface of each roller 6 projects from one guide plate to the other guide plate. Each roller 6 contacts the sheet P that is conveyed on the sheet-conveying route 2. Each roller 6 has a shaft extending to a direction that is perpendicular to the conveying direction of the sheet P. Each roller 6 rotates together with the conveyance of the sheet P.

In the curved sheet-conveying route 20, the rollers 6 are positioned on the inner guide plate which is arranged inside in the curved portion thereof. This enables the sheet P to be conveyed with it contacting the rollers 6. At the same time, it is possible to prevent the surface of the sheet P, on which the image has been formed, from contacting the inner guide plate.

The elevating mechanism 7 is installed in every roller 6 arranged on the sheet-conveying route 2 or each of the rollers 6 arranged at positions that may contact the end surface P1 of the sheet P along the width direction thereof by the register fluctuation operation.

The part of the circumferential surface of each roller 6 with the elevating mechanism 7 moves between a position in which it projects from the inner guide plate and a position from which it escapes from the inner guide plate.

Figure 3A:
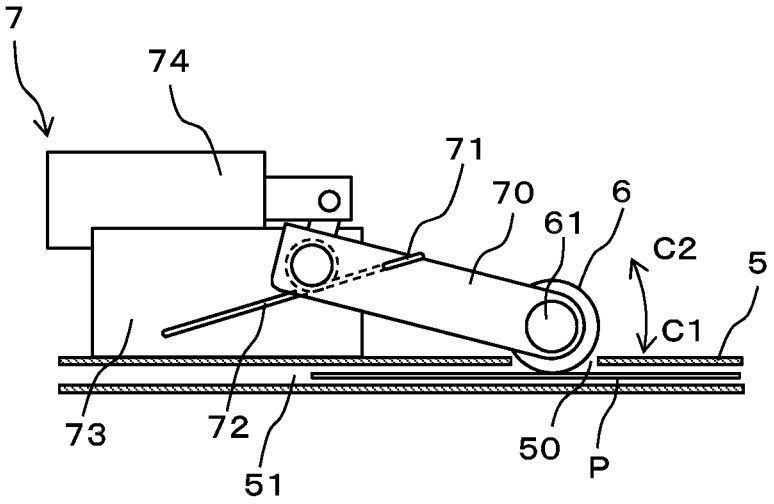
FIG. 3A is a side view of an elevating mechanism.
Figure 3B:
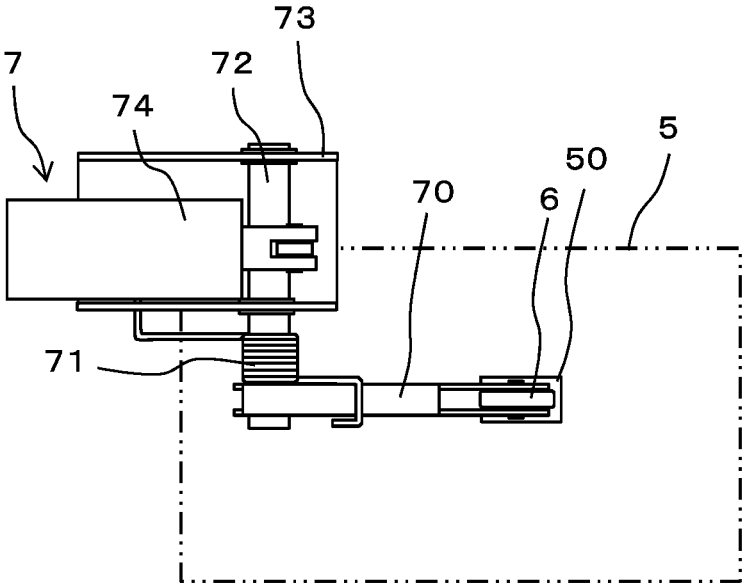
FIG. 3B is a top plan view of the elevating mechanism shown in FIG. 3A.

FIGS. 3A and 3B show an example of the elevating mechanism 7. The elevating mechanism 7 includes an arm 70 which rotatably supports the roller 6 around the shaft 61 of the roller 6, a spring 71 which urges the arm 70 to a direction on which the roller 6 projects from the inner guide plate, a shaft 72 of the arm 70 in which the arm 70 rotates around the shaft 72, a bearing member 73 which rotatably supports the shaft 72, and a roller-elevating solenoid 74 which rotates the shaft 72.

By the elevating mechanism 7, when the roller-elevating solenoid 74 is controlled to stop its driving, the arm 70 rotates around shaft 72 to a direction shown in an arrow C1 by force of the spring 71, so that the part of the circumferential surface of the roller 6 projects from an opening 50 of the inner guide plate into the sheet-conveying route 51. The roller 6 then contacts the sheet P which is conveyed on the sheet-conveying route 2 (see FIG. 3A). Further, by the elevating mechanism 7, when the roller-elevating solenoid 74 is controlled to be driven, the arm 70 rotates around shaft 72 to a direction shown in an arrow C2 against the force of the spring 71, so that the part of the circumferential surface of the roller 6 escapes from the opening 50 of the inner guide plate and the sheet-conveying route 51. The roller 6 then does not contact the sheet P which is conveyed on the sheet-conveying route 2.

Configuration Example of Image-Forming Apparatus According to the Embodiment

Figure 4:
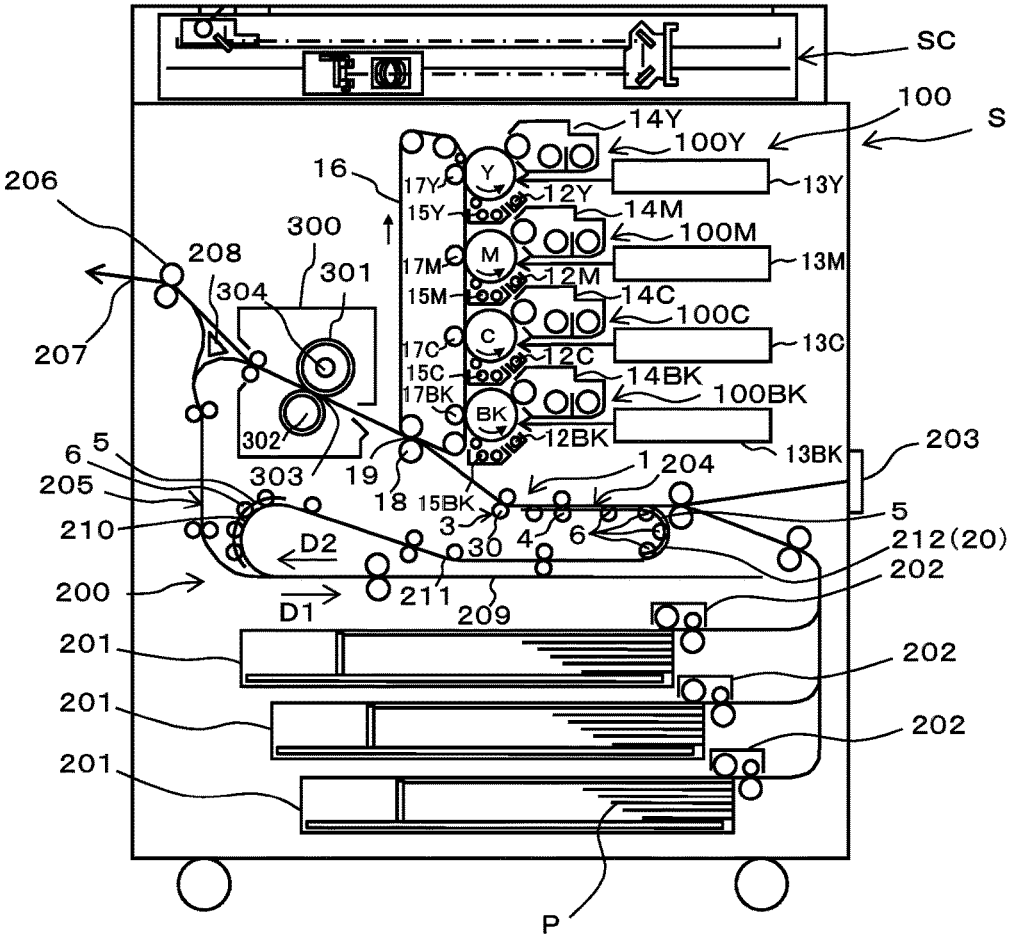
FIG. 4 is a schematic illustration of an image-forming apparatus that uses the sheet-conveying device according to the embodiment of the invention.

FIG. 4 schematically shows an image-forming apparatus that uses the sheet-conveying device according to the embodiment of the invention. The following will describe the image-forming apparatus S using the sheet-conveying device according to the embodiment of the invention more in detail with reference to FIG. 4.

The image-forming apparatus S is an image-forming apparatus of an electrophotographic system such as a copier. The image-forming apparatus S is a so-called color image-forming apparatus of a tandem type, in which plural photoreceptors are arranged vertically so as to be opposed to one intermediate transfer belt to form a full color image thereon.

The image-forming apparatus S is provided with a document-reading device SC, an image-forming portion 100, a sheet-conveying portion 200, and a fixing portion 300.

The document-reading device SC scans and exposes an image on the document using an optical system of a scanning and exposing device. The document-reading device SC reads reflected right by its line image sensor to obtain an image signal. It is to be noted that the document-reading device SC may be configured so that automatic document feeder, not shown, for automatically feeding the documents is mounted thereon.

The image-forming portion 100 includes an image-forming unit 100Y which forms a yellow (Y) image, an image-forming unit 100M which forms a magenta (M) image, an image-forming unit 100C which forms a cyan (C) image and an image-forming unit 100K which forms a black (BK) image.

The image-forming unit 100Y contains a photosensitive drum Y, a charging portion 12Y positioned around the photosensitive drum Y, an optical writing portion 13Y, a developing portion 14Y and a drum cleaner 15Y. Similarly, the image-forming unit 100M contains a photosensitive drum M, a charging portion 12M positioned around the photosensitive drum M, an optical writing portion 13M, a developing portion 14M and a drum cleaner 15M. The image-forming unit 100C contains a photosensitive drum C, a charging portion 12C positioned around the photosensitive drum C, an optical writing portion 13C, a developing portion 14C and a drum cleaner 15C. The image-forming unit 100K contains a photosensitive drum BK, a charging portion 12BK positioned around the photosensitive drum BK, an optical writing portion 13BK, a developing portion 14BK and a drum cleaner 15BK.

The charging portion 12Y charges a static charge uniformly around the surface of the photosensitive drum Y. The exposing portion 13Y scans and exposes a surface of the photosensitive drum Y to form an electrostatic latent image on the photosensitive drum Y. The developing portion 14Y develops the electrostatic latent image formed on the surface of the photosensitive drum Y by using toner. Accordingly, a visible toner image corresponding to yellow is formed on the photosensitive drum Y.

Similarly, the charging portion 12M charges a static charge uniformly around the surface of the photosensitive drum M. The exposing portion 13M scans and exposes a surface of the photosensitive drum M to form an electrostatic latent image on the photosensitive drum m. The developing portion 14M develops the electrostatic latent image formed on the surface of the photosensitive drum M by using toner. Accordingly, a visible toner image corresponding to the magenta is formed on the photosensitive drum M.

The charging portion 12C charges a static charge uniformly around the surface of the photosensitive drum C. The exposing portion 13C scans and exposes a surface of the photosensitive drum C to form an electrostatic latent image on the photosensitive drum C. The developing portion 14C develops the electrostatic latent image formed on the surface of the photosensitive drum C by using toner. Accordingly, a visible toner image corresponding to cyan is formed on the photosensitive drum C.

The charging portion 12BK charges a static charge uniformly around the surface of the photosensitive drum BK. The exposing portion 13BK scans and exposes a surface of the photosensitive drum BK to form an electrostatic latent image on the photosensitive drum BK. The developing portion 14BK develops the electrostatic latent image formed on the surface of the photosensitive drum BKC by using toner. Accordingly, a visible toner image corresponding to black is formed on the photosensitive drum BK.

Primary transfer rollers 17Y, 17M, 17C and 17BK transfer the images formed on the photosensitive drums Y, M, C and BK one by one onto predetermined positions of an intermediate transfer belt 16 which is a belt-like intermediate transfer member.

Secondary transfer rollers 18 transfer each color image transferred onto the intermediate transfer belt 16 to the sheet P, which is conveyed by the sheet-conveying portion 200, at a predetermined timing. The secondary transfer rollers 18 are arranged so that they contact the intermediate transfer belt 16 with any pressure. Under this condition, they form a transfer nip portion 19 and transfer the images on the sheet P with them conveying the sheet P.

The sheet-conveying portion 200 includes feeding tray, in this embodiment, plural feeding trays 201, containing the sheets P and feeders 202 which feed the sheets from the feeding trays 201. The sheet-conveying portion 200 also includes a main sheet-conveying route 204 on which the sheet P fed from the feeder 202 or the sheet P fed from an external feeder 203 is conveyed, and reverse sheet-conveying route 205 in which the sheet P is reversed.

The sheet-conveying route from the feeder 202 which feeds the sheets P from the feeding trays 201, to a sheet-ejecting port 207 from which ejection rollers eject the sheet P, constitutes the main sheet-conveying route 204. The sheet-conveying route from the external feeder 203 comes together the main sheet-conveying route 204 at an upstream side of a confluent portion of the main sheet-conveying route 204 and the reverse sheet-conveying route 205.

The reverse sheet-conveying route 205 branches from the main sheet-conveying route 204 at a downstream side of the fixing portion 300. The reverse sheet-conveying route 205 includes a change-over gate 208 at a branch portion of the main sheet-conveying route 204 and the reverse sheet-conveying route 205. The reverse sheet-conveying route 205 includes a first reverse sheet-conveying route 209 which is diverged from the main sheet-conveying route 204, in this embodiment, downward and extends almost horizontally below the main sheet-conveying route 204. In the first reverse sheet-conveying route 209, the conveying direction of the sheet P alters from a direction shown in an arrow D1 to a direction shown in an arrow D2.

The reverse sheet-conveying route 205 also includes a second reverse sheet-conveying route 210 diverged upward from the first reverse sheet-conveying route 209 in connection with the conveying direction shown in the arrow D2 and curved to one direction, and a third reverse sheet-conveying route 211 which extends from the second reverse sheet-conveying route 210 along the first reverse sheet-conveying route 209. The reverse sheet-conveying route 205 further includes a fourth reverse sheet-conveying route 212 which is curved from the third reverse sheet-conveying route 211 to the other direction and comes together the main sheet-conveying route 204 at an upstream side of the register portion 3.

In the image-forming apparatus S, an image is formed on an upward surface of the sheet P conveyed on the main sheet-conveying route 204 and passed through the transfer nip portion 19 and the fixing portion 300. When the images are formed on both surfaces of the sheet P, the sheet P, in which the image has been formed on one upward surface, is conveyed from the main sheet-conveying route 204 to the first reverse sheet-conveying route 209 of the reverse sheet-conveying route 205, so that the image formed surface of the sheet P faces downward.

When the sheet P conveyed to the first reverse sheet-conveying route 209 is conveyed from the second reverse sheet-conveying route 210 to the third reverse sheet-conveying route 211, the image formed surface of the sheet P faces upward. Further, when the sheet P conveyed to the third reverse sheet-conveying route 211 is conveyed from the fourth reverse sheet-conveying route 212 to the main sheet-conveying route 204, the image formed surface of the sheet P again faces downward. This enables the sheet P to be reversed, thereby allowing the image to be formed on the other upward surface of the sheet P.

In the image-forming apparatus S, the main sheet-conveying route 204 in a range from an upstream side of the transfer nip portion 19 to the register portion 3 at a downstream side of the fourth reverse sheet-conveying route 212, the fourth reverse sheet-conveying route 212 confluent with the main sheet-conveying route 204, the third reverse sheet-conveying route 211 and the second reverse sheet-conveying route 210 constitute the sheet-conveying route 2 of sheet-conveying device 1 according to this invention. The fourth reverse sheet-conveying route 212 and the second reverse sheet-conveying route 210 constitute the curved sheet-conveying routes 20 of the sheet-conveying route 2.

The main sheet-conveying route 204 and the reverse sheet-conveying route 205 are provided with the guide members 5 and the rollers 6 which are positioned according to the above-mentioned arrangement. Every roller 6A or each of the rollers 6 arranged at positions that may contact the end surface P1 of the sheet P along the width direction thereof by the register fluctuation operation is provided with the elevating mechanism 7.

In the image-forming apparatus S, when the images are formed on both surfaces of the sheet P, the image formed surface of the sheet P faces inside in connection with the curved direction of the sheet-conveying route in the fourth reverse sheet-conveying route 212. In order to prevent the image formed surface of the sheet P from contacting the inner guide plate, the rollers 6 are provided on the inner guide plate in the fourth reverse sheet-conveying route 212. Further, the image formed surface of the sheet P faces outside in connection with the curved direction of the sheet-conveying route in the second reverse sheet-conveying route 210. In order to prevent the image formed surface of the sheet P from contacting the outer guide plate, the rollers 6 are provided on the outer guide plate in the second reverse sheet-conveying route 210.

The fixing portion 300 performs fixing on the sheet, to which the image has been transferred, to fix the image formed on the sheet P. The fixing portion 300 is provided with a pair of fixing rollers 301 and 302 as fixing members, which are contacted to each other with any pressure. The contact of the fixing rollers 301 and 302 to each other with any pressure enables forming a fixing nip portion 303.

Further, the fixing portion 300 is provided with a fixing heater 304 that heats the fixing roller 301 as heating member for heating the fixing member. The fixing heater 304 switches on by turning on electricity. As the fixing heater 304, for example, halogen lamp is used. The fixing portion 300 conveys the sheet P and fixes the image on the sheet P by fixing the image with the fixing rollers 301 and 302 by applying any force to the sheet P and with the fixing heater 304 by heating the sheet P.

Figure 5:
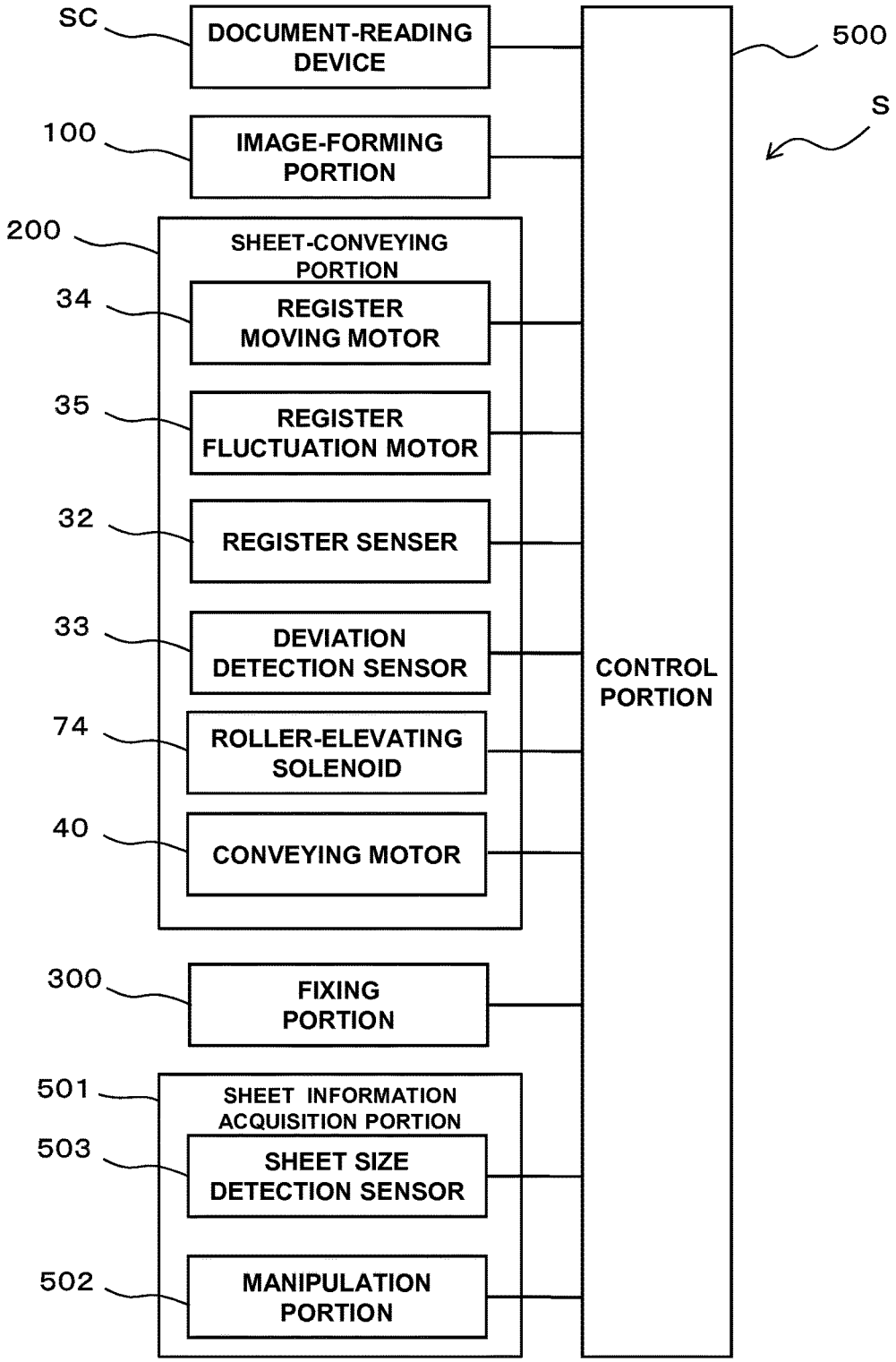
FIG. 5 is a functional block diagram showing a control function of the image-forming apparatus that uses the sheet-conveying device according to the embodiment of the invention.

Control Function Example of Image-Forming Apparatus that Uses Sheet-Conveying Device According to Embodiment of the Invention FIG. 5 shows a control function example of the image-forming apparatus according to an embodiment of the invention. The following will describe a control function on an operation to escape the roller 6 in the register fluctuation operation.

The image-forming apparatus S includes a control portion 500 that controls a series of operations in the image-forming apparatus S from the feeding of the sheet P to the ejection of the sheet P through the image formation. The control portion 500 is provided with a micro processer, such as CPU or MPU and a memory such as RAM and ROM as storage member.

An ordinary operation to form an image on the sheet P in the image-forming apparatus Swill be described. The control portion 500 controls the sheet-conveying portion 200 to convey the sheet P. The control portion 500 also controls the image-forming portion 100 to form the image on the sheet P based on image data acquired from the document by the document-reading device SC or image data acquired from outside. The control portion 500 further controls the fixing portion 300 to fix the image on the sheet P and to eject the sheet P on which the image is formed.

The image-forming apparatus S includes a register moving motor 34 for performing the register fluctuation operation. This register moving motor 34 rotates or stops rotating the register rollers 30 in the register portion 3 constituting the sheet-conveying portion 200. The image-forming apparatus S also includes a register fluctuation motor 35 for moving the register rollers 30 to a sheet-moving direction. The image-forming apparatus S further includes a conveying motor 40 for rotating or stop rotating the conveying rollers 4.

The control portion 500 constitutes a control portion for controlling about the operation of escaping the rollers 6 in the register fluctuation operation of the sheet-conveying device 1, which has been described with reference to FIG. 1 and the like. The control portion 500 acquires a range in which the sheet P can be moved on the basis of sheet information of the sheet P including a size thereof, which has been acquired by a sheet information acquisition portion 501. The control portion 500 then controls the elevating mechanism 7 to drive the roller-elevating solenoids 74 so that the rollers stayed within the range in which the sheet P can be moved are escaped from the guide member 5.

In the image-forming apparatus S, the sheet information acquisition portion 501 includes a manipulation portion 502 through which a user selects a size of the sheet P, a sheet size detection sensor 503 that detects a size of each of the sheets P set in the feeding trays 201 and the like.

The control portion 500 calculates the rollers arranged at positions in which the end surface P1 of the sheet P along the width direction thereof may contact any end surface 60 of the rollers 6 in the register fluctuation operation from a width of the sheet P specified on the basis of size information of the sheet P selected by the manipulation portion 502 and size information of the sheet P detected by the sheet size detection sensor 503 and a previously set maximum moving amount of the sheet P corresponding to the width of the sheet P. The control portion 500 then produces positional information of the rollers 6 to be escaped. The control portion 500 may be provided with a table in which the size information of the sheet P and the positional information of the rollers 6 to be escaped are corresponded to each other.

The control portion 500 acquires positional information of the sheet P along the width direction thereof by the deviation detection sensor 33 and calculates the rollers arranged at positions in which the end surface P1 of the sheet P along the width direction thereof may contact any end surface 60 of the rollers 6 in the register fluctuation operation from a width of the sheet P specified on the basis of size information of the sheet P and the positional information of the sheet P along the width direction thereof. The control portion 500 may be provided with a table in which the positional information of the sheet P and the positional information of the rollers 6 to be escaped are corresponded to each other.

The control portion 500 controls the elevating mechanism 7 to drive the roller-elevating solenoids 74 corresponding to the rollers 6 specified by the positional information of the rollers to be escaped at a predetermined escape starting timing before the end surface P1 of the sheet P reaches the corresponding rollers 6 in the register fluctuation operation so that the corresponding rollers are escaped from the guide member 5.

The control portion 500 then controls the elevating mechanism 7 to drive the roller-elevating solenoids 74 corresponding to the escaped rollers 6 specified by the positional information of the rollers to be escaped at a predetermined escape finishing timing after the end surface P1 of the sheet P reaches the corresponding rollers 6 in the register fluctuation operation so that the corresponding rollers project from the guide member 5.

Figure 6:
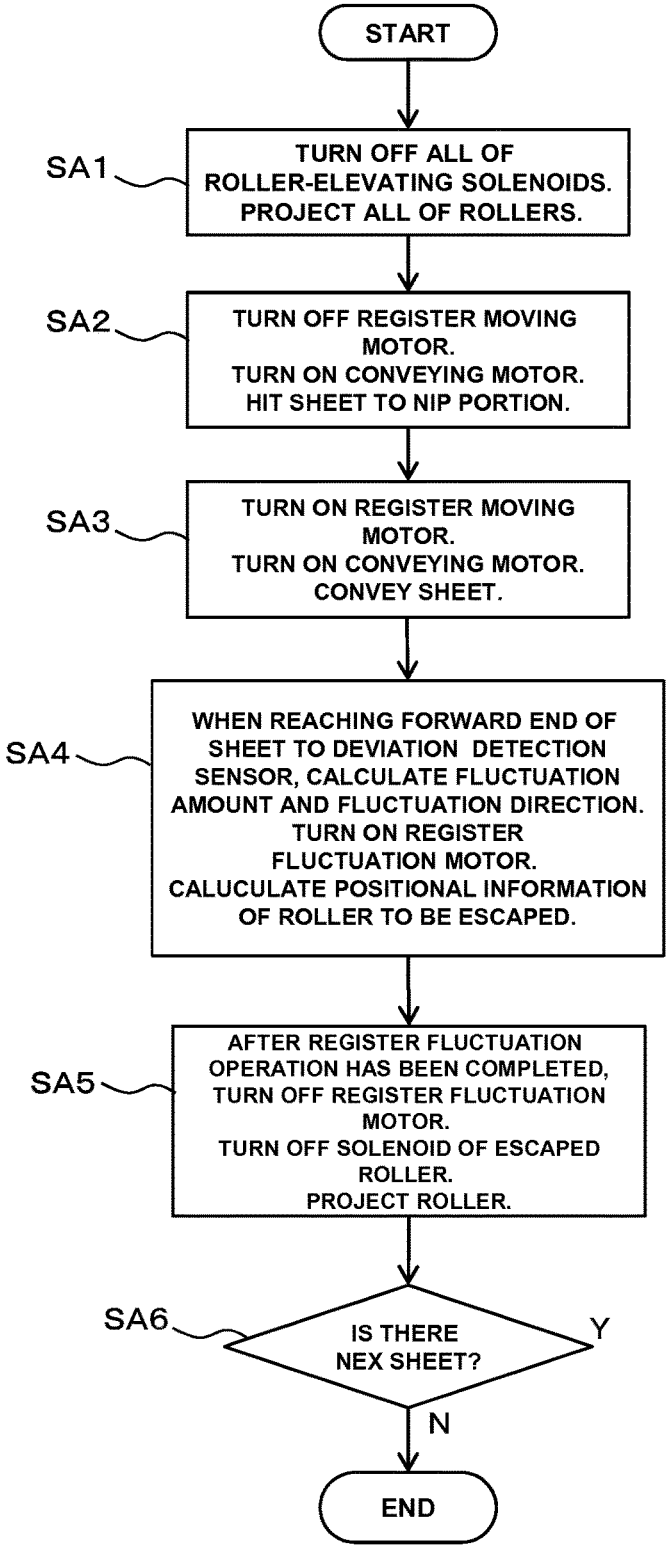
FIG. 6 is a flowchart showing an example of the operation of the image-forming apparatus that uses the sheet-conveying device according to the embodiment of the invention.
Figure 7:
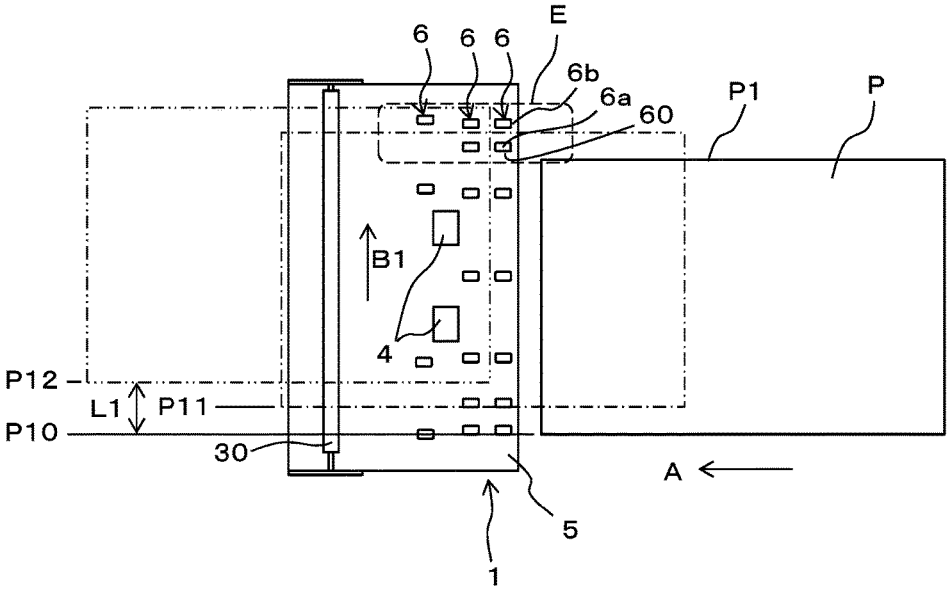
FIG. 7 is a diagram showing a relationship between movements of the sheet and the positions of the rollers to be escaped in a register fluctuation operation that is a sheet-position correction operation.
Figure 8:
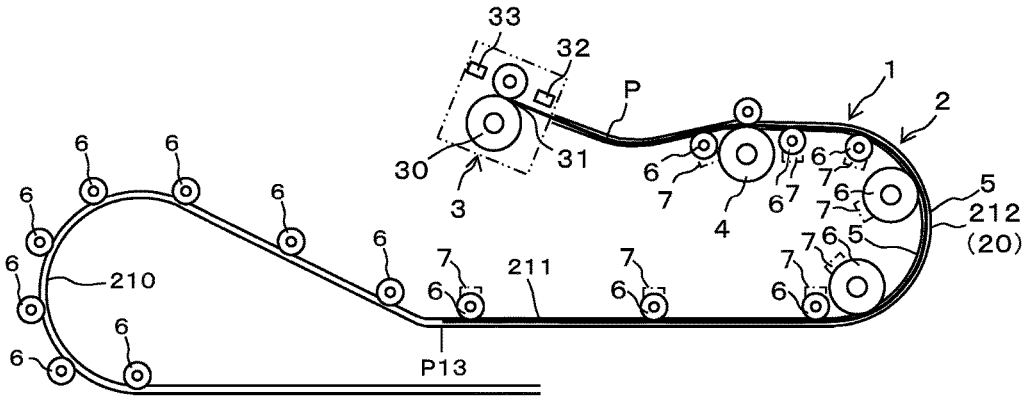
FIG. 8 is a diagram showing a relationship between a size of the sheet and the positions of the rollers to be escaped.

Operation Example of Image-Forming Apparatus that Uses Sheet-Conveying Device According to Embodiment of the Invention FIG. 6 shows an example of the operation of the image-forming apparatus that uses the sheet-conveying device according to the embodiment of the invention. FIG. 7 shows a relationship between movements of the sheet and the positions of the rollers to be escaped in the register fluctuation operation. FIG. 8 shows a relationship between a size of the sheet and the positions of the rollers to be escaped. The following will describe an example of the operations of the image-forming apparatus S and the sheet-conveying device 1 with reference to drawings.

At a step, SA1 of FIG. 6, the control portion 500 turns off the roller-elevating solenoids 74 of all of the rollers 6, each of which is provided with the elevating mechanism 7 and can be escaped, and sets an initial state thereof in which all of the rollers 6 project from the guide member 5.

At a step, SA2 of FIG. 6, the control portion 500 controls the conveying motor 40 to drive the conveying rollers 4 while it controls the register moving motor 34 to stop the register rollers 30. The control portion 500 then controls the conveying motor 40 to convey the sheet P at a predetermined amount after the register sensor 32 detects the forward end of the sheet P and to stop the conveying rollers 4.

This enables the forward end of the sheet P to hit the nip portion 31 of the register rollers 30. By conveying the sheet P between the nip portion 31 of the register rollers 30 and the conveying rollers 4 so that the sheet P is curved to be a loop, the skew of the sheet P can be corrected.

At a step, SA3 of FIG. 6, the control portion 500 controls the register moving motor 34 to drive the register rollers 30 and controls the conveying motor 40 to drive the conveying rollers 4. This enables the sheet P in which the skew has been corrected to start the conveyance thereof.

At a step, SA4 of FIG. 6, the control portion 500 acquires positional information of the sheet P along the width direction thereof when the forward end of the sheet P reaches the deviation detection sensor 33 to calculate a sheet-moving amount and a sheet-moving direction of the register rollers 30 and to produce fluctuation information. The control portion 500 also calculates the rollers arranged at positions in which the end surface P1 of the sheet P along the width direction thereof may contact any end surface 60 of the rollers 6 in the register fluctuation operation from a width of the sheet P specified on the basis of size information of the sheet P and positional information of the sheet P along the width direction thereof, thereby producing positional information of the rollers 6 to be escaped.

In this embodiment, the control portion 500 controls the elevating mechanisms 7 to drive the roller-elevating solenoids 74 corresponding to the rollers 6 specified by the positional information of the rollers 6 to be escaped to escape the corresponding rollers 6 from the guide member 5 before the register fluctuation motor 35 is driven. The control portion 500 also controls the register fluctuation motor 35 to move the register rollers 30 to a width direction shown in the arrow B1 that is perpendicular to the conveying direction of the sheet P based on the fluctuation information after the corresponding rollers 6 are escaped from the guide member 5. This enables the position of the sheet P along the width direction thereof to be corrected.

In a case shown in FIG. 7, a position P10 of the end surface of the sheet P before the register fluctuation operation, the skew of which has been corrected, is indicated by a solid line. When an fluctuation amount of the register rollers 30, namely, an fluctuation amount of the sheet P is set to be L1, the sheet P, the skew of which has been corrected, is moved so that the position P10 indicated by a solid line of the end surface of the sheet P is moved to a position P12 indicated by a two-dot chain line when the register fluctuation operation is completed via a position P11 indicated by a long dashed short dashed line by the register fluctuation operation.

In the above embodiments, it is determined that the end surface 60 of each of the rollers 6 arranged in a range E shown in a dotted line may contact the end surface P1 of the sheet P moved in the register fluctuation operation. The rollers 6 arranged in the range E shown in the dotted line are set to be escaped as the positional information of the roller to be escaped.

At a step, SA5 of FIG. 6, the control portion 500 control the register fluctuation motor 35 to stop the movement of the register rollers 30 when the correction of the position of the sheet P along the width direction thereof is finished. The control portion 500 also control the elevating mechanisms 7 to drive the roller-elevating solenoids 74 corresponding to the rollers 6 specified by the positional information of the rollers to be escaped to project the corresponding rollers 6 from the guide member 5 when stopping the movement of the register rollers 30.

At a step, SA6 of FIG. 6, the control portion 500 determines whether or not there is a next sheet. If it determines that there is a next sheet, then the control portion 500 returns to the step SA1 wherein the register fluctuation operation and the escape of the rollers 6 are performed on the next sheet. When stopping the movement of the register rollers 30, the control portion 500 projects the corresponding rollers from the guide member 5, so that the rollers 6 which has been escaped at a case of the preceding sheet P project into the sheet-conveying route before the forward end of the next sheet reaches the escaped rollers 6. This prevents an image formed surface of the next sheet from contacting the guide member 5.

Since the control portion 500 recognizes a position of the sheet P in the register fluctuation operation, in a case shown in FIG. 7, all of the rollers 6 within the range E shown in the dotted line are escaped from the guide member 5 when the sheet P stays in the position P10 indicated by the solid line. When the sheet P moves to the position P11 indicated by the long dashed short dashed line, the end surface P1 of the sheet P passes through the roller 6*a*. The control portion 500 then controls the elevating mechanism 7 of the roller 6*a* to project the roller 6*a* from the guide member 5. The roller 6*b* maintains its escaped condition. When the sheet P moves to the position P12 indicated by the two-dot chain line, the end surface P1 of the sheet P passes through the roller 6*b*. The control portion 500 then controls the elevating mechanism 7 of the roller 6*b* to project the roller 6*b* from the guide member 5.

Thus, the rollers 6 may be controlled so as to escape and project based on the positional information of the sheet P moved in the register fluctuation operation. Since the control portion 500 recognizes a moving position of the sheet P in the register fluctuation operation, the roller(s) moving away from the moved sheet P in the register fluctuation operation do (does) not project from the guide member 5.

The maximum size of the sheet to be processed is previously fixed in the image-forming apparatus S. Therefore, as shown in FIG. 8, the rollers provided at a downstream side from a position P13 of the sheet-conveying route 2 corresponding to a rear end of the sheet P having the processible maximum size while the forward end of this sheet P is hit against the nip portion 31 of the register rollers 30 are provided with their elevating mechanisms 7. On the other hand, it is unnecessary that the rollers provided at an upstream side from the position P13 of the sheet-conveying route 2 are provided with any elevating mechanisms 7.

According to this embodiment, it is possible to prevent the image formed surface of the conveying sheet P from contacting the guide member 5 by providing the rollers 6 which project from the guide member 5 constituting the sheet-conveying route 51 of the sheet P, contact the sheet P and rotate with the conveyance of the sheet P. This prevents the image scratch from occurring.

The control portion 500 searches the rollers 6 arranged at positions that may contact the end surface P1 of the moving sheet P along the width direction thereof in the register fluctuation operation and calculates the positional information of the rollers 6 to be escaped. The control portion 500 controls the elevating mechanisms 7 of the rollers 6 to be escaped to escape the rollers 6 specified by the positional information thereof before the register fluctuation operation starts. This prevents the end surface P1 of the sheet P moving along the width direction thereof from contacting any end surfaces 60 of the rollers 6. It is thus possible to prevent any defect from occurring in the end surface P1 of the sheet P.

Further, when the end surface of the roller 6 is made to be curved, it is also possible to prevent any defect from occurring in the end surface P1 of the sheet P which moves to the width direction thereof and runs onto the roller 6. By a resistance caused when the sheet P runs onto the roller 6, the sheet 6 may be flexed. On the other hand, escaping the roller(s) 6 that may contact the sheet P allows no resistance caused when the sheet P, which moves to the width direction thereof, runs onto the roller 6 to occur. This prevents the sheet 6 from being flexed.

Figure 9:
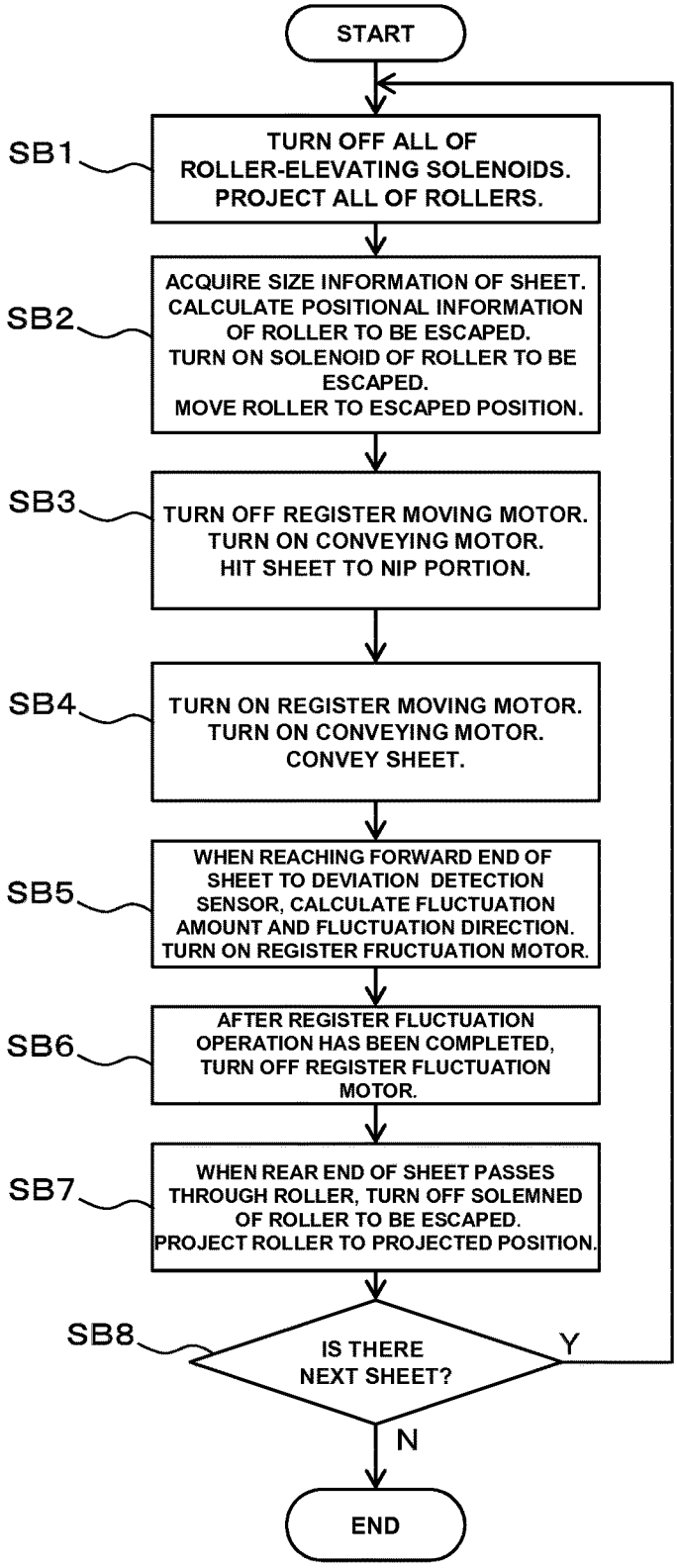
FIG. 9 is a flowchart showing another example of the operation of the image-forming apparatus that uses the sheet-conveying device according to the embodiment of the invention.

FIG. 9 shows another example of the operation of the image-forming apparatus that uses the sheet-conveying device according to the embodiment of the invention. The following will describe another example of the operations of the image-forming apparatus S and the sheet-conveying device 1 with reference to drawings.

At a step, SB1 of FIG. 9, the control portion 500 turns off the roller-elevating solenoids 74 of all of the rollers 6, each of which is provided with the elevating mechanism 7 and can be escaped, and sets an initial state thereof in which all of the rollers 6 project from the guide member 5.

At a step, SB2 of FIG. 9, the control portion 500 calculates the rollers arranged at positions in which the end surface P1 of the sheet P along the width direction thereof may contact any end surface 60 of the rollers 6 in the register fluctuation operation from a width of the sheet P specified on the basis of size information of the sheet P selected by the manipulation portion 502 and size information of the sheet P detected by the sheet size detection sensor 503 and a previously set maximum moving amount of the sheet P corresponding to the width of the sheet P. The control portion 500 then produces positional information of the rollers 6 to be escaped.

At a step, SB3 of FIG. 9, the control portion 500 controls the conveying motor 40 to drive the conveying rollers 4 while it controls the register moving motor 34 to stop the register rollers 30. The control portion 500 then controls the conveying motor 40 to convey the sheet P at a predetermined amount after the register sensor 32 detects the forward end of the sheet P and to stop the conveying rollers 4.

This enables the forward end of the sheet P to hit the nip portion 31 of the register rollers 30. By conveying the sheet P between the nip portion 31 of the register rollers 30 and the conveying rollers 4 so that the sheet P is curved to be a loop, the skew of the sheet P can be corrected.

At a step, SB4 of FIG. 9, the control portion 500 controls the register moving motor 34 to drive the register rollers 30 and controls the conveying motor 40 to drive the conveying rollers 4. This enables the sheet P in which the skew has been corrected to start the conveyance thereof.

At a step, SB5 of FIG. 9, the control portion 500 acquires positional information of the sheet P along the width direction thereof when the forward end of the sheet P reaches the deviation detection sensor 33 to calculate a sheet-moving amount and a sheet-moving direction of the register rollers 30 and to produce fluctuation information.

The control portion 500 also controls the register fluctuation motor 35 to move the register rollers 30 to a width direction shown in the arrow B1 that is perpendicular to the conveying direction of the sheet P based on the fluctuation information. This enables the position of the sheet P along the width direction thereof to be corrected.

In this example, the rollers 6 arranged at positions that may contact the end surface P1 of the sheet P along the width direction thereof in the register fluctuation operation escape from the guide member 5 before the operation to correct the skew of the sheet P. Therefore, in the register fluctuation operation, the end surface P1 of the sheet P does not contact any end surfaces 60 of the rollers 6.

At a step, SB6 of FIG. 9, the control portion 500 control the register fluctuation motor 35 to stop the movement of the register rollers 30 when the correction of the position of the sheet P along the width direction thereof is finished.

At a step, SB7 of FIG. 9, the control portion 500 also control the elevating mechanisms 7 to drive the roller-elevating solenoids 74 corresponding to the rollers 6 specified by the positional information of the rollers to be escaped to project the corresponding rollers 6 from the guide member 5 when the rear end of the sheet P passes through the escaped rollers 6.

At a step, SB8 of FIG. 9, the control portion 500 determines whether or not there is a next sheet. If it determines that there is a next sheet, then the control portion 500 returns to the step SB1 wherein the register fluctuation operation and the escape of the rollers 6 are performed on the next sheet. When the rear end of the sheet P passes through the escaped rollers 6, the control portion 500 projects the corresponding rollers from the guide member 5, so that the rollers 6 which has been escaped at a case of the preceding sheet P project into the sheet-conveying route before the forward end of the next sheet reaches the escaped rollers 6. This prevents an image formed surface of the next sheet from contacting the guide member 5.

Figure 10:
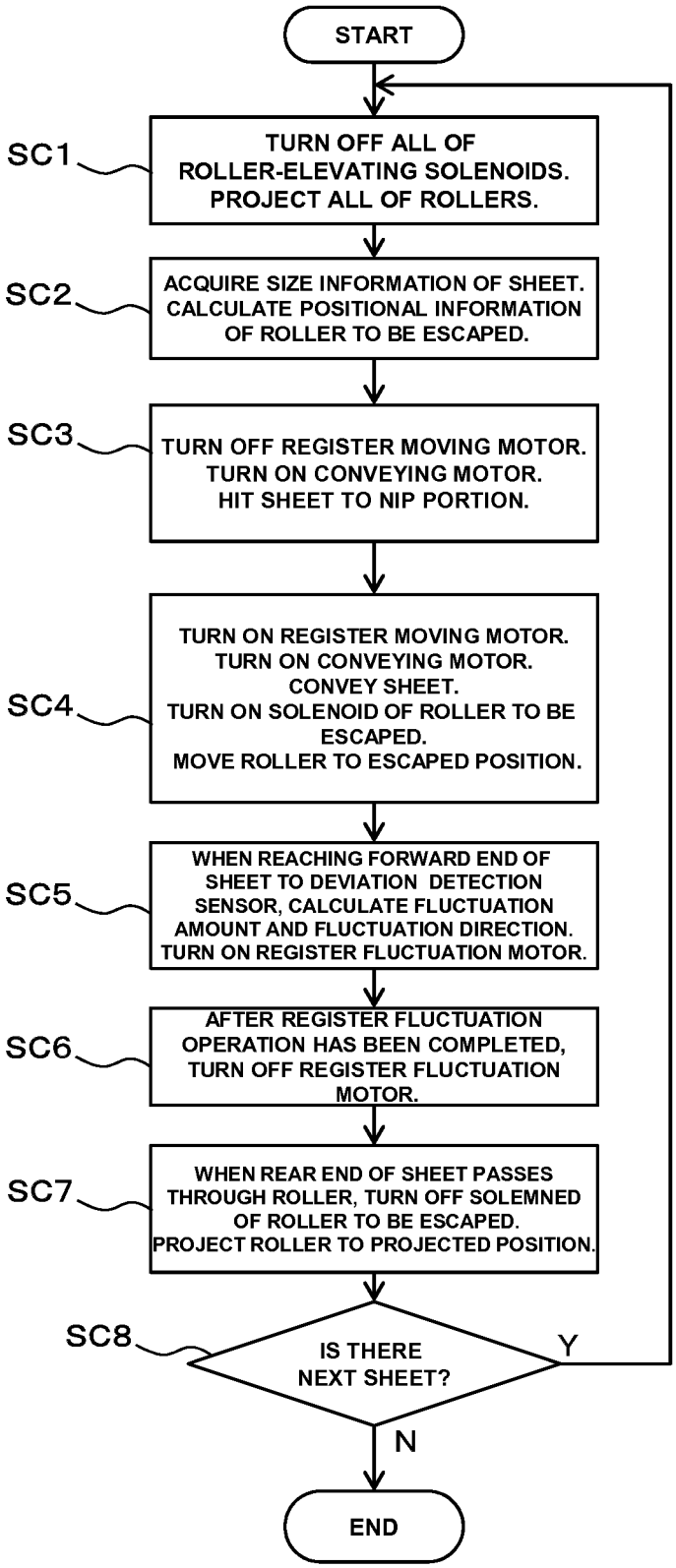
FIG. 10 is a flowchart showing other example of the operation of the image-forming apparatus that uses the sheet-conveying device according to the embodiment of the invention.

FIG. 10 shows other example of the operation of the image-forming apparatus that uses the sheet-conveying device according to the embodiment of the invention. The following will describe other example of the operations of the image-forming apparatus S and the sheet-conveying device 1 with reference to drawings.

At a step, SC1 of FIG. 10, the control portion 500 turns off the roller-elevating solenoids 74 of all of the rollers 6, each of which is provided with the elevating mechanism 7 and can be escaped, and sets an initial state thereof in which all of the rollers 6 project from the guide member 5.

At a step, SC2 of FIG. 10, the control portion 500 calculates the rollers arranged at positions in which the end surface P1 of the sheet P along the width direction thereof may contact any end surface 60 of the rollers 6 in the register fluctuation operation from a width of the sheet P specified on the basis of size information of the sheet P selected by the manipulation portion 502 and size information of the sheet P detected by the sheet size detection sensor 503 and a previously set maximum moving amount of the sheet P corresponding to the width of the sheet P. The control portion 500 then produces positional information of the rollers 6 to be escaped.

At a step, SC3 of FIG. 10, the control portion 500 controls the conveying motor 40 to drive the conveying rollers 4 while it controls the register moving motor 34 to stop the register rollers 30. The control portion 500 then controls the conveying motor 40 to convey the sheet P at a predetermined amount after the register sensor 32 detects the forward end of the sheet P and to stop the conveying rollers 4.

This enables the forward end of the sheet P to hit the nip portion 31 of the register rollers 30. By conveying the sheet P between the nip portion 31 of the register rollers 30 and the conveying rollers 4 so that the sheet P is curved to be a loop, the skew of the sheet P can be corrected.

At a step, SC4 of FIG. 10, the control portion 500 controls the register moving motor 34 to drive the register rollers 30 and controls the conveying motor 40 to drive the conveying rollers 4. This enables the sheet P in which the skew has been corrected to start the conveyance thereof. The control portion 500 then controls the elevating mechanisms 7 to drive the roller-elevating solenoids 74 corresponding to the rollers 6 specified by the positional information of the rollers to be escaped and to escape the corresponding rollers 6 from the guide member 5.

At a step, SC5 of FIG. 10, the control portion 500 acquires positional information of the sheet P along the width direction thereof when the forward end of the sheet P reaches the deviation detection sensor 33 to calculate a sheet-moving amount and a sheet-moving direction of the register rollers 30 and to produce fluctuation information.

The control portion 500 also controls the register fluctuation motor 35 to move the register rollers 30 to a width direction shown in the arrow B1 that is perpendicular to the conveying direction of the sheet P based on the fluctuation information. This enables the position of the sheet P along the width direction thereof to be corrected.

In this example, the rollers 6 arranged at positions that may contact the end surface P1 of the sheet P along the width direction thereof in the register fluctuation operation escape from the guide member 5 at timing of starting the conveyance of the sheet P. Therefore, in the register fluctuation operation, the end surface P1 of the sheet P does not contact any end surfaces 60 of the rollers 6.

At a step, SC6 of FIG. 10, the control portion 500 control the register fluctuation motor 35 to stop the movement of the register rollers 30 when the correction of the position of the sheet P along the width direction thereof is finished.

At a step, SC7 of FIG. 10, the control portion 500 also control the elevating mechanisms 7 to drive the roller-elevating solenoids 74 corresponding to the rollers 6 specified by the positional information of the rollers to be escaped to project the corresponding rollers 6 from the guide member 5 when the rear end of the sheet P passes through the escaped rollers 6.

At a step, SC8 of FIG. 10, the control portion 500 determines whether or not there is a next sheet. If it determines that there is a next sheet, then the control portion 500 returns to the step SB1 wherein the register fluctuation operation and the escape of the rollers 6 are performed on the next sheet. When the rear end of the sheet P passes through the escaped rollers 6, the control portion 500 projects the corresponding rollers from the guide member 5, so that the rollers 6 which has been escaped at a case of the preceding sheet P project into the sheet-conveying route before the forward end of the next sheet reaches the escaped rollers 6. This prevents an image formed surface of the next sheet from contacting the guide member 5.

This invention is applicable to an apparatus which has the roller(s) that rotate(s) together with the conveyance of the sheet and corrects the position of the sheet along the width direction thereof.

The terms and expressions which have been employed in the foregoing description are used therein as terms of description and not of limitation, and these are no intention, in the use of such terms and expressions, of excluding equivalent of the features shown and described or portions thereof, it being recognized that the scope of the invention is defined and limited only by the claims.

What is claimed is:

1. A sheet-conveying device that conveys a sheet, the device comprising:

register rollers that move in a direction which is perpendicular to a conveying direction of the sheet with the register rollers nipping the sheet, and correct a position of the sheet;

a guide member that constitutes a sheet-conveying route, the guide member being provided at an upstream side of the register rollers along the conveying direction of the sheet;

a plurality of rollers, each roller projecting from the guide member, contacting the sheet and rotating together with the conveyance of the sheet, the plurality of rollers being provided at plural portions of the guide member at the upstream side of the register rollers along the conveying direction of the sheet;

an elevating mechanism that elevates each of the plurality of rollers between a position in which the roller projects from the guide member and into the sheet-conveying route and a position in which the roller does not project from the guide member so as to escape from the sheet-conveying route;

a deviation detection sensor that detects a position of the sheet in a width direction of the sheet along the direction which is perpendicular to the conveying direction of the sheet; and a control portion that is configured to perform a sheet-position correction operation in which the register rollers move along the direction which is perpendicular to the conveying direction of the sheet based on positional information of the sheet along the width direction thereof, wherein the positional information is detected by the deviation detection sensor, and wherein the position of the sheet in the width direction thereof is corrected along the direction which is perpendicular to the conveying direction of the sheet, wherein the control portion is configured to, in this order: (i) perform control to correct skew by nipping the sheet with the register rollers, (ii) control the deviation detection sensor to detect the positional information of the sheet along the width direction thereof, (iii) based on the detected positional information of the sheet along the width direction, search from among the plurality of rollers for a roller that is positioned at a position where the roller would contact an end surface of the sheet, while the sheet is being moved along the width direction thereof during the sheet-position correction operation, calculate positional information of the searched roller that is positioned at said position, and control the elevating mechanism so that the searched roller specified based on the calculated positional information does not project from the guide member and escapes from the sheet-conveying route before the sheet-position correction operation starts, and (iv) based on the detected positional information of the sheet along the width direction, perform the sheet-position correction operation in which the register rollers move along the direction which is perpendicular to the conveying direction of the sheet.

2. The sheet-conveying device according to claim 1, wherein the control portion is configured to search from among the plurality of rollers for the roller that is positioned at said position based on size information of the conveying sheet, and a width of the sheet specified by the size information and a predetermined set maximum moving amount of the sheet during the sheet-position correction operation corresponding to the width of the sheet.

3. The sheet-conveying device according to claim 2, wherein the control portion is configured to search from among the plurality of rollers for the roller that is positioned at said position based further on the positional information of the sheet along the width direction thereof, and the width of the sheet specified by the size information of the conveying sheet.

4. The sheet-conveying device according to claim 1, wherein when the sheet-position correction operation to move the sheet along the direction which is perpendicular to the conveying direction of the sheet has been completed, the control portion is configured to control the elevating mechanism to project from the guide member and into the sheet-conveying route, the searched roller which has been escaped from the sheet-conveying route before the sheet-position correction operation starts.

5. The sheet-conveying device according to claim 1, wherein the control portion is configured to control the elevating mechanism to project from the guide member and into the sheet-conveying route, the searched roller which has been escaped from the sheet-conveying route before a forward end of a sheet next to a preceding sheet on which the sheet-position correction operation has been performed reaches the searched roller.

6. The sheet-conveying device according to claim 1, wherein the control portion is configured to control the elevating mechanism to project from the guide member and into the sheet-conveying route, the searched roller which has been escaped from the sheet-conveying route before a forward end of a sheet next to a preceding sheet on which the sheet-position correction operation has been performed reaches the searched roller and after the sheet-position correction operation to move the preceding sheet along the direction which is perpendicular to the conveying direction of the sheet has been completed.

7. An image-forming apparatus comprising:

an image-forming portion that forms an image on a sheet; and a sheet-conveying device that conveys the sheet, wherein the device includes:

register rollers that move in a direction which is perpendicular to a conveying direction of the sheet with the register rollers nipping the sheet, and correct a position of the sheet;

a guide member that constitutes a sheet-conveying route, the guide member being provided at an upstream side of the register rollers along the conveying direction of the sheet;

a plurality of rollers, each roller projecting from the guide member, contacting the sheet and rotating together with the conveyance of the sheet, the plurality of rollers being provided at plural portions of the guide member at the upstream side of the register rollers along the conveying direction of the sheet;

an elevating mechanism that elevates each of the plurality of rollers between a position in which the roller projects from the guide member and into the sheet-conveying route and a position in which the roller does not project from the guide member so as to escape from the sheet-conveying route;

a deviation detection sensor that detects a position of the sheet in a width direction of the sheet along the direction which is perpendicular to the conveying direction of the sheet; and a control portion that is configured to perform a sheet-position correction operation in which the register rollers move along the direction which is perpendicular to the conveying direction of the sheet based on positional information of the sheet along the width direction thereof, wherein the positional information is detected by the deviation detection sensor, and wherein the position of the sheet in the width direction thereof is corrected along the direction which is perpendicular to the conveying direction of the sheet, and wherein the control portion is configured to, in this order: (i) perform control to correct skew by nipping the sheet with the register rollers, (ii) control the deviation detection sensor to detect the positional information of the sheet along the width direction thereof, (iii) based on the detected positional information of the sheet along the width direction, search from among the plurality of rollers for a roller that is positioned at a position where the roller would contact an end surface of the sheet, while the sheet is being moved along the width direction thereof during the sheet-position correction operation, calculate positional information of the searched roller that is positioned at said position, and control the elevating mechanism so that the searched roller specified based on the calculated positional information does not project from the guide member and escapes from the sheet-conveying route before the sheet-position correction operation starts, and (iv) based on the detected positional information of the sheet along the width direction, perform the sheet-position correction operation in which the register rollers move along the direction which is perpendicular to the conveying direction of the sheet.

8. The image-forming apparatus according to claim 7, wherein the sheet-conveying device is provided with a reverse sheet-conveying route in which the sheet, on one surface of which an image has been formed, is reversed;

wherein the reverse sheet-conveying route includes a first reverse sheet-conveying route diverged from a main sheet-conveying route in which the sheet on which the image is formed by the image-forming portion is conveyed, a second reverse sheet-conveying route diverged from the first reverse sheet-conveying route and curved to one direction, a third reverse sheet-conveying route extending from the second reverse sheet-conveying route along the first reverse sheet-conveying route, and a fourth reverse sheet-conveying route curved from the third reverse sheet-conveying route to the other direction and entering into the main sheet-conveying route at the upstream side of the register rollers; and wherein the plurality of rollers are arranged at the guide member positioned at an inner part to a curved direction of the sheet-conveying route in the fourth reverse sheet-conveying route and at the guide member positioned at an outer part to the curved direction of the sheet-conveying route in the second reverse sheet-conveying route.

9. A sheet-conveying device that conveys a sheet, the device comprising:

register rollers that move in a direction which is perpendicular to a conveying direction of the sheet with the register rollers nipping the sheet, and correct a position of the sheet;

a guide member that constitutes a sheet-conveying route, the guide member being provided at an upstream side of the register rollers along the conveying direction of the sheet;

a plurality of rollers, each roller projecting from the guide member, contacting the sheet and rotating together with the conveyance of the sheet, the plurality of rollers being provided at plural portions of the guide member at the upstream side of the register rollers along the conveying direction of the sheet;

an elevating mechanism that elevates each of the plurality of rollers between a position in which the roller projects from the guide member and into the sheet-conveying route and a position in which the roller does not project from the guide member so as to escape from the sheet-conveying route;

a deviation detection sensor that detects a position of the sheet in a width direction of the sheet along the direction which is perpendicular to the conveying direction of the sheet; and a control portion that is configured to perform a sheet-position correction operation in which the register rollers move along the direction which is perpendicular to the conveying direction of the sheet based on positional information of the sheet along the width direction thereof, wherein the positional information is detected by the deviation detection sensor, and wherein the position of the sheet in the width direction thereof is corrected along the direction which is perpendicular to the conveying direction of the sheet, wherein the control portion is configured to, in this order: (i) perform control to correct skew by nipping the sheet with the register rollers, (ii) control the deviation detection sensor to detect the positional information of the sheet along the width direction thereof, (iii) based on the detected positional information of the sheet along the width direction, calculate positional information of a roller that is from among the plurality of rollers and that is positioned at a position where the roller would contact an end surface of the sheet while the sheet is being moved along the width direction thereof during the sheet-position correction operation, and control the elevating mechanism so that only the roller specified based on the calculated positional information does not project from the guide member and is escaped from the sheet-conveying route before the sheet-position correction operation starts, and (iv) based on the detected positional information of the sheet along the width direction, perform the sheet-position correction operation in which the register rollers move along the direction which is perpendicular to the conveying direction of the sheet.

10. A sheet-conveying device that conveys a sheet, the device comprising:

a pair of nipping rollers that move in a direction which is perpendicular to a conveying direction of the sheet with the pair of nipping rollers nipping the sheet, and correct a position of the sheet;

a guide member that constitutes a sheet-conveying route, the guide member being provided at an upstream side of the pair of nipping rollers along the conveying direction of the sheet;

a plurality of rollers, each roller projecting from the guide member, contacting the sheet and rotating together with the conveyance of the sheet, the plurality of rollers being provided at plural portions of the guide member at the upstream side of the pair of nipping rollers along the conveying direction of the sheet;

an elevating mechanism that elevates each of the plurality of rollers between a position in which the roller projects from the guide member and into the sheet-conveying route and a position in which the roller does not project from the guide member so as to escape from the sheet-conveying route;

a deviation detection sensor that detects a position of the sheet in a width direction of the sheet along the direction which is perpendicular to the conveying direction of the sheet; and a control portion that is configured to perform a sheet-position correction operation in which the pair of nipping rollers move along the direction which is perpendicular to the conveying direction of the sheet based on positional information of the sheet along the width direction thereof, wherein the positional information is detected by the deviation detection sensor, and wherein the position of the sheet in the width direction thereof is corrected along the direction which is perpendicular to the conveying direction of the sheet, wherein the control portion is configured to, in this order: (i) perform control to correct skew by nipping the sheet with the pair of nipping rollers, (ii) control the deviation detection sensor to detect the positional information of the sheet along the width direction thereof, (iii) based on the detected positional information of the sheet along the width direction, search from among the plurality of rollers for a roller that is positioned at a position where the roller would contact an end surface of the sheet, while the sheet is being moved along the width direction thereof during the sheet-position correction operation, calculate positional information of the searched roller that is positioned at said position, and control the elevating mechanism so that the searched roller specified based on the calculated positional information does not project from the guide member and escapes from the sheet-conveying route before the sheet-position correction operation starts, and (iv) based on the detected positional information of the sheet along the width direction, perform the sheet-position correction operation in which the pair of nipping rollers move along the direction which is perpendicular to the conveying direction of the sheet.

11. The sheet-conveying device according to claim 10, wherein the control portion is configured to search from among the plurality of rollers for the roller that is positioned at said position based on size information of the conveying sheet, and a width of the sheet specified by the size information and a predetermined set maximum moving amount of the sheet during the sheet-position correction operation corresponding to the width of the sheet.

12. The sheet-conveying device according to claim 11, wherein the control portion is configured to search from among the plurality of rollers for the roller that is positioned at said position based further on the positional information of the sheet along the width direction thereof, and the width of the sheet specified by the size information of the conveying sheet.

13. The sheet-conveying device according to claim 10, wherein when the sheet-position correction operation to move the sheet along the direction which is perpendicular to the conveying direction of the sheet has been completed, the control portion is configured to control the elevating mechanism to project from the guide member and into the sheet-conveying route, the searched roller which has been escaped from the sheet-conveying route before the sheet-position correction operation starts.

14. The sheet-conveying device according to claim 10, wherein the control portion is configured to control the elevating mechanism to project from the guide member and into the sheet-conveying route, the searched roller which has been escaped from the sheet-conveying route before a forward end of a sheet next to a preceding sheet on which the sheet-position correction operation has been performed reaches the searched roller.

15. The sheet-conveying device according to claim 10, wherein the control portion is configured to control the elevating mechanism to project from the guide member and into the sheet-conveying route, the searched roller which has been escaped from the sheet-conveying route before a forward end of a sheet next to a preceding sheet on which the sheet-position correction operation has been performed reaches the searched roller and after the sheet-position correction operation to move the preceding sheet along the direction which is perpendicular to the conveying direction of the sheet has been completed.

16. An image-forming apparatus comprising:

an image-forming portion that forms an image on a sheet; and a sheet-conveying device that conveys the sheet, wherein the device includes:

a pair of nipping rollers that move in a direction which is perpendicular to a conveying direction of the sheet with the pair of nipping rollers nipping the sheet, and correct a position of the sheet;

a guide member that constitutes a sheet-conveying route, the guide member being provided at an upstream side of the pair of nipping rollers along the conveying direction of the sheet;

a plurality of rollers, each roller projecting from the guide member, contacting the sheet and rotating together with the conveyance of the sheet, the plurality of rollers being provided at plural portions of the guide member at the upstream side of the pair of nipping rollers along the conveying direction of the sheet;

an elevating mechanism that elevates each of the plurality of rollers between a position in which the roller projects from the guide member and into the sheet-conveying route and a position in which the roller does not project from the guide member so as to escape from the sheet-conveying route;

a deviation detection sensor that detects a position of the sheet in a width direction of the sheet along the direction which is perpendicular to the conveying direction of the sheet; and a control portion that is configured to perform a sheet-position correction operation in which the pair of nipping rollers move along the direction which is perpendicular to the conveying direction of the sheet based on positional information of the sheet along the width direction thereof, wherein the positional information is detected by the deviation detection sensor, and wherein the position of the sheet in the width direction thereof is corrected along the direction which is perpendicular to the conveying direction of the sheet, and wherein the control portion is configured to, in this order: (i) perform control to correct skew by nipping the sheet with the pair of nipping rollers, (ii) control the deviation detection sensor to detect the positional information of the sheet along the width direction thereof, (iii) based on the detected positional information of the sheet along the width direction, search from among the plurality of rollers for a roller that is positioned at a position where the roller would contact an end surface of the sheet, while the sheet is being moved along the width direction thereof during the sheet-position correction operation, calculate positional information of the searched roller that is positioned at said position, and control the elevating mechanism so that the searched roller specified based on the calculated positional information does not project from the guide member and escapes from the sheet-conveying route before the sheet-position correction operation starts, and (iv) based on the detected positional information of the sheet along the width direction, perform the sheet-position correction operation in which the pair of nipping rollers move along the direction which is perpendicular to the conveying direction of the sheet.

17. The image-forming apparatus according to claim 16, wherein the sheet-conveying device is provided with a reverse sheet-conveying route in which the sheet, on one surface of which an image has been formed, is reversed;

wherein the reverse sheet-conveying route includes a first reverse sheet-conveying route diverged from a main sheet-conveying route in which the sheet on which the image is formed by the image-forming portion is conveyed, a second reverse sheet-conveying route diverged from the first reverse sheet-conveying route and curved to one direction, a third reverse sheet-conveying route extending from the second reverse sheet-conveying route along the first reverse sheet-conveying route, and a fourth reverse sheet-conveying route curved from the third reverse sheet-conveying route to the other direction and entering into the main sheet-conveying route at the upstream side of the pair of nipping rollers; and wherein the plurality of rollers are arranged at the guide member positioned at an inner part to a curved direction of the sheet-conveying route in the fourth reverse sheet-conveying route and at the guide member positioned at an outer part to the curved direction of the sheet-conveying route in the second reverse sheet-conveying route.

18. A sheet-conveying device that conveys a sheet, the device comprising:

a pair of nipping rollers that move in a direction which is perpendicular to a conveying direction of the sheet with the pair of nipping rollers nipping the sheet, and correct a position of the sheet;

a guide member that constitutes a sheet-conveying route, the guide member being provided at an upstream side of the pair of nipping rollers along the conveying direction of the sheet;

a plurality of rollers, each roller projecting from the guide member, contacting the sheet and rotating together with the conveyance of the sheet, the plurality of rollers being provided at plural portions of the guide member at the upstream side of the pair of nipping rollers along the conveying direction of the sheet;

an elevating mechanism that elevates each of the plurality of rollers between a position in which the roller projects from the guide member and into the sheet-conveying route and a position in which the roller does not project from the guide member so as to escape from the sheet-conveying route;

a deviation detection sensor that detects a position of the sheet in a width direction of the sheet along the direction which is perpendicular to the conveying direction of the sheet; and a control portion that is configured to perform a sheet-position correction operation in which the pair of rollers move along the direction which is perpendicular to the conveying direction of the sheet based on positional information of the sheet along the width direction thereof, wherein the positional information is detected by the deviation detection sensor, and wherein the position of the sheet in the width direction thereof is corrected along the direction which is perpendicular to the conveying direction of the sheet, wherein the control portion is configured to, in this order: (i) perform control to correct skew by nipping the sheet with the pair of nipping rollers, (ii) control the deviation detection sensor to detect the positional information of the sheet along the width direction thereof, (iii) based on the detected positional information of the sheet along the width direction, calculate positional information of a roller that is from among the plurality of rollers and that is positioned at a position where the roller would contact an end surface of the sheet while the sheet is being moved along the width direction thereof during the sheet-position correction operation, and control the elevating mechanism so that only the roller specified based on the calculated positional information does not project from the guide member and is escaped from the sheet-conveying route before the sheet-position correction operation starts, and (iv) based on the detected positional information of the sheet along the width direction, perform the sheet-position correction operation in which the pair of nipping rollers move along the direction which is perpendicular to the conveying direction of the sheet.

* * * * *